US009903117B2

(12) United States Patent
Gandhi

(10) Patent No.: US 9,903,117 B2
(45) Date of Patent: Feb. 27, 2018

(54) STIFFNESS CONTROL IN A STRUCTURAL MEMBER HAVING AN INFLATABLE COMPONENT

(71) Applicant: Toyota Motor Engineering & Manufacturing North America, Inc., Erlanger, KY (US)

(72) Inventor: Umesh N. Gandhi, Farmington Hills, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 15/200,646

(22) Filed: Jul. 1, 2016

(65) Prior Publication Data

US 2018/0002929 A1 Jan. 4, 2018

(51) Int. Cl.
*E04H 15/20* (2006.01)
*E04C 3/36* (2006.01)

(52) U.S. Cl.
CPC ..... *E04C 3/36* (2013.01)

(58) Field of Classification Search
CPC ..... E04C 3/36; E04H 15/20
USPC ..... 52/2.13; 410/119; 150/514
See application file for complete search history.

(56) References Cited

U.S. PATENT DOCUMENTS 3,199,689 A 12/1960 Feldkamp
3,987,736 A * 10/1976 Miller ..... B60P 7/16 206/522
4,136,788 A * 1/1979 Robbins ..... B65D 31/04 206/522
4,834,382 A * 5/1989 Spector ..... A63B 41/02 273/DIG. 20
5,522,757 A * 6/1996 Ostrowski ..... A63B 43/02 446/220
5,908,275 A * 6/1999 Howlett, Jr. ..... B29D 22/02 410/119
5,997,422 A * 12/1999 Cooper ..... A63B 41/08 473/599
6,162,149 A * 12/2000 Scatterday ..... A63B 21/00189 482/44
8,021,252 B2 * 9/2011 Goedoen ..... A63B 41/08 473/600
8,342,991 B2 * 1/2013 Spector ..... A63B 41/00 473/576

(Continued)

FOREIGN PATENT DOCUMENTS

EP 1344554 A2 9/2009

OTHER PUBLICATIONS

Ou et al., "jamSheets: Thin Interfaces with Tunable Stiffness Enabled by Layer Jamming", Feb. 16-19, 2014, 8 pages.

*Primary Examiner* — Beth A Stephan
(74) *Attorney, Agent, or Firm* — Christopher G. Darrow; Darrow Mustafa PC

(57) ABSTRACT

A structural member includes an inflatable member having an elastic, imperforate wall, an outer layer enclosing the inflatable member so as to define a cavity between the inflatable member and the outer layer, and at least one separator member positioned in the cavity so as to separate the outer layer from the inflatable member. The outer layer has at least one opening formed therealong and structured to enable fluid communication between the cavity and an exterior of the structural member.

14 Claims, 2 Drawing Sheets

(56) References Cited

U.S. PATENT DOCUMENTS

| | | | | |
|---|---|---|---|---|
| 2002/0136614 | A1* | 9/2002 | Elze | B60P 7/065 410/119 |
| 2012/0172160 | A1* | 7/2012 | Marc | B29C 66/545 473/604 |
| 2013/0284297 | A1* | 10/2013 | Hacikyan | F16L 55/134 138/93 |
| 2013/0340645 | A1* | 12/2013 | Graber | F42B 3/04 102/482 |
| 2015/0314844 | A1* | 11/2015 | Sellmeyer | A47G 9/1045 441/125 |

* cited by examiner

STIFFNESS CONTROL IN A STRUCTURAL MEMBER HAVING AN INFLATABLE COMPONENT

TECHNICAL FIELD

The present invention relates to inflatable structural members which may be stowed in a relatively compact, uninflated condition, and inflated to an end-use condition when required.

BACKGROUND

Inflatable structural members may be used for a variety of purposes. Such members may be stored in an uninflated, relatively compact condition until needed. The members may be inflated to an end-use shape when needed. However, when a structural member is inflated, it may be difficult for the member to maintain its desired shape under an applied load. Also, inflatable structural members designed for increased stiffness or resistance to deformation under load may be excessively bulky and/or difficult to fold and store compactly prior to deployment or use.

SUMMARY

In one aspect of the embodiments described herein, a structural member includes an inflatable member having an elastic, imperforate wall, an outer layer enclosing the inflatable member so as to define a cavity between the inflatable member and the outer layer, and at least one separator member positioned in the cavity so as to separate the outer layer from the inflatable member. The outer layer has at least one opening formed therealong and structured to enable fluid communication between the cavity and an exterior of the structural member.

In another aspect of the embodiments described herein, a structural member includes an inflatable member having an elastic, imperforate wall, and an outer layer enclosing the inflatable portion so as to define a cavity between the inflatable member and the outer layer. At least one separator member is positioned in the cavity between the inflatable member and the outer layer so as to separate the outer layer and the inflatable member. The at least one separator member is unattached to both the inflatable member and the outer layer, and is movable with respect to the inflatable member and the outer layer prior to inflation of the inflatable member.

DETAILED DESCRIPTION

Embodiments described herein relate to a structural member with an inflatable component. The structural member has an innermost, inflatable member, an outer layer, and at least one separator member positioned between the inflatable member and the outer layer. When the inflatable component is uninflated, the layers forming the structural member may be spaced apart or lightly contacting each other, so that normal forces and the resulting frictional forces between the layers are minimized. In this state, the structural member may be relatively flexible and pliable. When the inflatable component is inflated, the constituent layers are forced against each other, thereby increasing the normal forces acting on the layers and the resultant friction between the layers. This acts to increase a stiffness of a composite wall of the structural member, formed by the combined thicknesses of the inflatable member, the at least one separator member, and the outer layer.

Figure 1:
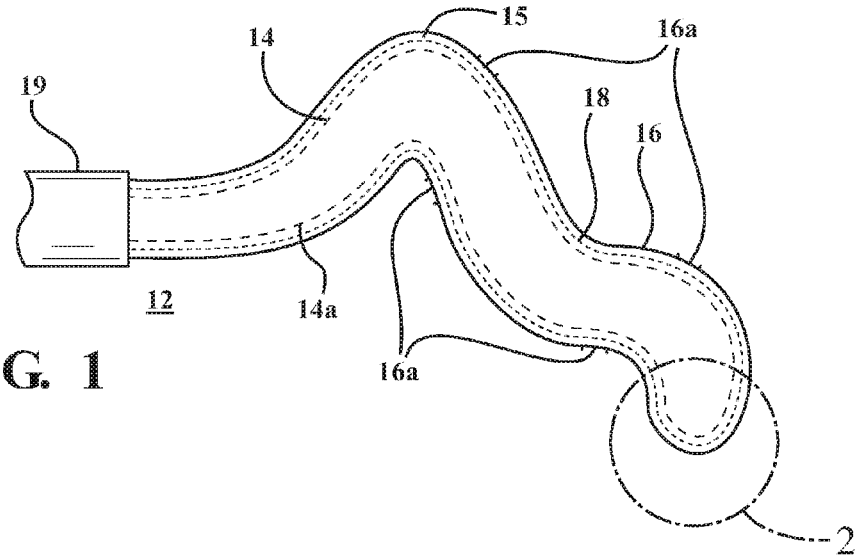
FIG. 1 is a schematic side view of a structural member having an inflatable component, in accordance with an embodiment described herein and prior to inflation of the inflatable component.

FIGS. 1-5 show views of one embodiment of a structural member 12 in accordance with an embodiment described herein. In the embodiment shown, structural member 12 includes an innermost, inflatable member 14 and an outer layer 16 enclosing the inflatable member 14 so as to define a cavity 15 between the inflatable member 14 and the outer layer 16. At least one separator member 18 is positioned in the cavity 15 between the inflatable member 14 and the outer layer 16 so as to separate the outer layer and the inflatable member. FIG. 1 shows the structural member 12 attached to an inflation nozzle 19 with the inflatable member 14 uninflated. Because the outer layer 16 is not inflated and is not designed to trap gases, the outer layer need not be necessarily attached to the nozzle 19, or need not be attached to the nozzle so as to form an airtight seal.

Figure 2:
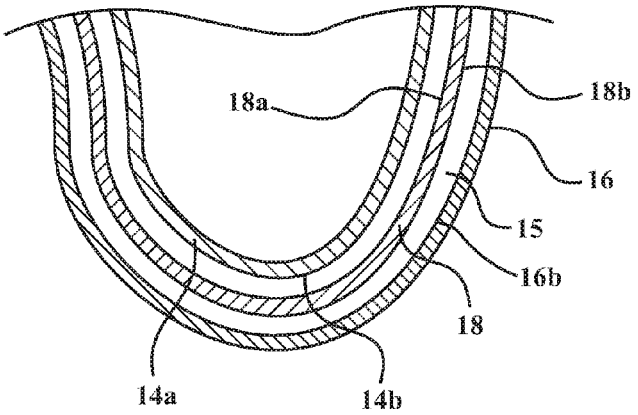
FIG. 2 is a side cross-sectional view of a portion of the structural member embodiment shown in FIG. 1.

Referring to FIG. 2, in some embodiments, inflatable member 14 has a gastight, elastic, imperforate wall 14*a*. The inflatable member 14 may be in the form of an inflatable bladder or bag, for example. An exterior surface 14*b* of the wall 14*a* may have a relatively high roughness, to aid in preventing or inhibiting sliding between the surface 14*b* and separator member 18 when the inflatable member 14 is inflated to the extent that it presses against the separator member 18 and forces the separator member 18 against the outer layer 16, as described herein. The inflatable member 14 may be formed from any material suitable for the purposes described herein. In particular embodiments, the inflatable member 14 is stretchable. The inflatable member 14 may be formed from an elastically stretchable material. For example, the inflatable member 14 may be formed from silicone rubber or a similar material.

The outer layer 16 has at least one opening 16*a* formed therealong and structured to enable fluid communication between the cavity 15 and an exterior of the structural member 12. The opening 16*a* is structured and positioned to aid in preventing air or gasses from becoming trapped and forming pockets between the inflatable member 14 and the outer layer 16. Such gas pockets may inhibit overall flexibility of the structural member prior to inflation of the inflatable member.

As shown in FIGS. 1, 3, 4 and 6, in some embodiments, the outer layer 16 may have a plurality of openings 16*a* formed therealong, where all of the openings 16*a* are structured to enable fluid communication between the cavity 15 and an exterior of the structural member 12. The outer layer 16 may be formed from any material suitable for the purposes described herein. In some embodiments, the outer layer 16 is formed from an elastically or resiliently stretchable material. Alternatively, the outer layer 16 may be formed from a material with little or no stretchability responsive to inflation and expansion of the inflatable member 14. In particular embodiments, the outer layer may be formed from a material having an elongation of up to about 20%. In particular embodiments, the outer layer may be formed from silicone rubber. In particular embodiments, the outer layer may be formed from a fiber-reinforced polymer.

Referring to FIG. 2, an interior surface 16*b* of the outer layer 16 may have a relatively high roughness, to aid in preventing or inhibiting sliding between the surface 16*b* and separator member 18 when the inflatable member 14 is inflated to the extent that it forces the separator member 18 against the outer layer interior surface 16*b*, as described herein.

The separator member 18 is structured and positioned so as to space the outer layer 16 apart from the inflatable member 14, and to facilitate relative movement of the outer layer with respect to the inflatable member 14 prior to inflation of the inflatable member. The separator member 18 aids in preventing an inner surface 16*b* of the outer layer 16 from contacting the exterior surface 14*b* of the inflatable member 14 prior to inflation. Since these surfaces 14*b* and 16*b* may be relatively rough, contact between these surfaces may cause friction between the surfaces, thereby inhibiting relative motion between the surfaces and reducing overall flexibility of the structural member prior to inflation of the inflatable member 14.

The separator member 18 may be unattached to the inflatable member 14 and the outer layer 16, and movable with respect to the inflatable member 14 and the outer layer 16 prior to inflation of the inflatable member 14. The terms "unattached" and "movable" as applied to any of the separator members described herein mean that the entire separator member is capable of moving relative to an associated inflatable member 14 and relative to an associated outer layer 16, and of shifting its position within the cavity 15 formed between the inflatable member 14 and the outer layer 16. The separator member 18 is thus merely placed between the inflatable member 14 and the outer layer 16 and is not attached to these elements in any way (for example, using adhesives or mechanical fasteners). This enables the separator member 18 to move freely within the cavity 15, subject only to contact forces between the separator member 18 and the inflatable member 14 and between the separator member and the outer layer 16.

The separator member 18 may also be structured to facilitate sliding of the separator member 18 with respect to the inflatable member 14, and also sliding of the outer layer 16 with respect to the separator member 18, prior to inflation of the inflatable member. This may promote overall flexibility of the structural member 12 prior to inflation of the inflatable member 14. For this purpose, the separator member 18 may have relatively smooth inner surfaces 18*a* and outer surfaces 18*b* facing the inflatable member 14 and the outer layer 16, respectively. These surfaces of the separator member 18 may be structured such that coefficients of static and kinetic friction between the separator member 18 and the outer layer are relatively low. In some embodiments, the separator member 18 may be structured such that coefficients of static and kinetic friction between the separator member 18 and the outer layer 16 are less than coefficients of static and kinetic friction between inflatable member 14 and the outer layer 16, and such that coefficients of static and kinetic friction between the separator member 18 and the inflatable member 14 are less than coefficients of static and kinetic friction between inflatable member 14 and the outer layer 16.

A static friction force $f_s$ may be defined as a force that must exerted to overcome static friction between two surfaces in contact before the surfaces can slide with respect to each other. Generally, the static friction $f_s$ force may be expressed as a product of the coefficient of static friction $\mu_s$ and a normal force N between the surfaces, according to the relation $f_s=\mu_s \times N$. Also, a kinetic friction force $f_k$ may be defined as a force that must exerted to keep two surfaces in sliding motion with respect to each other. Generally, the kinetic friction $f_k$ force may be expressed as a product of the coefficient of kinetic friction $\mu_k$ and a normal force N between the surfaces, according to the relation $f_k=\mu_k \times N$. The friction coefficients $\mu_s$ and $\mu_k$ for a given interface between any two components (for example, between the separator member 18 and the outer layer 16) may be adjusted by appropriate selection of separator member materials and surface finishes.

The roughnesses of the separator member surfaces 18*a* and 18*b* contacting the inflatable member 14 and the outer layer 16 may be specified so as to balance the need for relatively low sliding friction between the surfaces prior to inflation, against the need for sufficient frictional force between the surfaces to prevent or greatly inhibit relative sliding between the surfaces when the inflatable portion is inflated. The thickness of the separator member and the area and/or distribution of coverage of the inflatable member 14 by the separator member 18 may also be specified for the purposes of maintaining separation between the inflatable member 14 and the outer layer 16 both prior to inflation and after inflation of the inflatable member.

The separator member 18 may be formed from any material suitable for the purposes described herein. In particular embodiments, the separator member 18 is formed from a polymer material.

Figure 6:
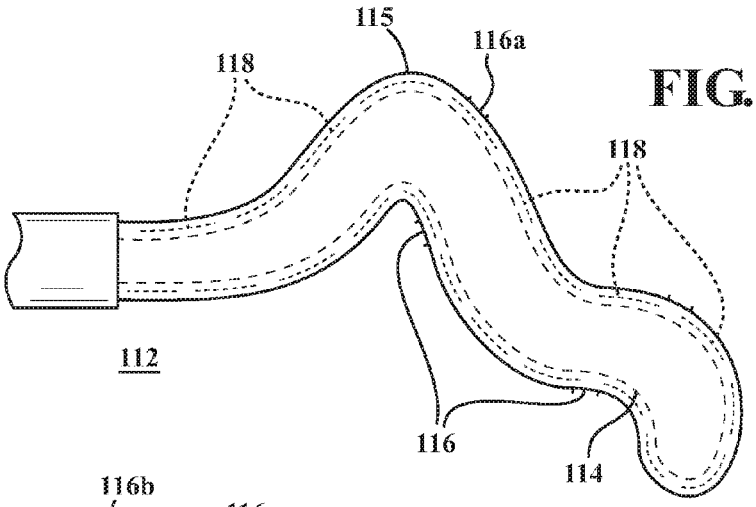
FIG. 6 is a schematic side view of a structural member having an inflatable component, in accordance with another embodiment described herein and prior to inflation of the inflatable component.
Figure 7:
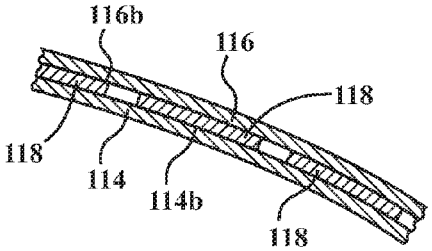
FIG. 7 is a cross-sectional view of a portion of the structural member embodiment shown in FIG. 6, after inflation of the inflatable component of the structural member.

In particular embodiments, and as shown in embodiment 112 of FIGS. 6 and 7, a plurality of discrete, individual separator members 118 may be positioned between the inflatable member 114 and the outer layer 116, each separator member 118 being independently movable with respect to the inflatable member 114 and the outer layer 116 prior to inflation of the inflatable member 114. Utilizing a plurality of smaller separate pieces as separator members may serve the purposes of preventing contact between the outer layer 116 and the inflatable member 114, while effectively articulating and distributing the separator function and enhancing overall flexibility of the structural member 112 prior to inflatable member inflation. FIG. 6 shows a side view of a structural member 112 containing a plurality of discrete separator members 118 positioned between an inflatable member 114 and an outer layer 116, and prior to inflation of the inflatable member. FIG. 7 shows the embodiment of FIG. 6 after inflation of the inflatable member 114 as the multiple individual separator members 118 are pressed by inflatable member 114 into intimate contact with outer layer 116, as previously described.

Prior to inflation of the inflatable member 14, the structural member 12 may be loose or foldable, as shown in FIGS. 1, 2, and 6. Because portions of the various layers 14, 16, and 18 may not be in contact with each other when the inflatable member 14 is uninflated, the distances between the inflatable member 14 and the separator member 18, between the separator member 18 and the outer layer 16, and between the inflatable member 14 and the outer layer 16 may vary along the extent of the structural member 12. The room allowed for the layers to space apart when inflatable member 14 is uninflated and the structure of the separator member 18 may facilitate low-friction and/or no-contact movement of the layers 14, 18, and 16 relative to each other when the inflatable member 14 is uninflated, thereby increasing pre-inflation flexibility and compactness.

Figure 3:
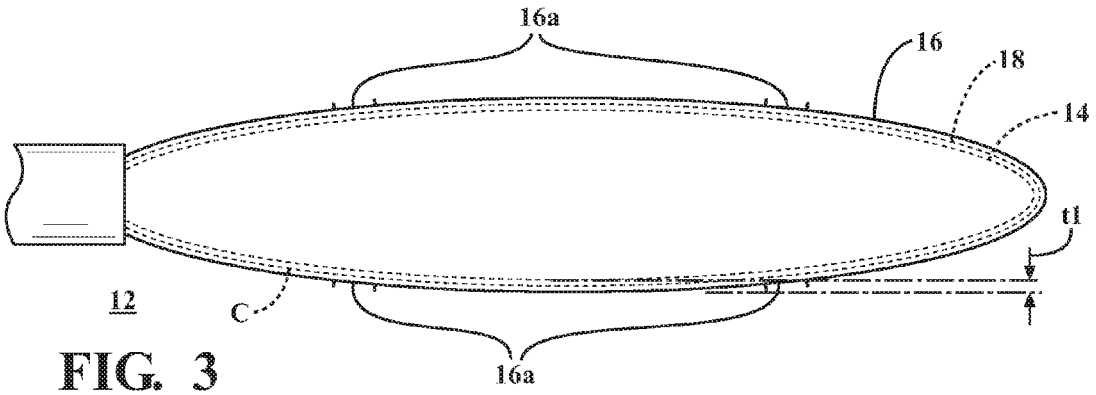
FIG. 3 is a schematic side view of the structural member of FIG. 1 after inflation of the inflatable component.
Figure 4:
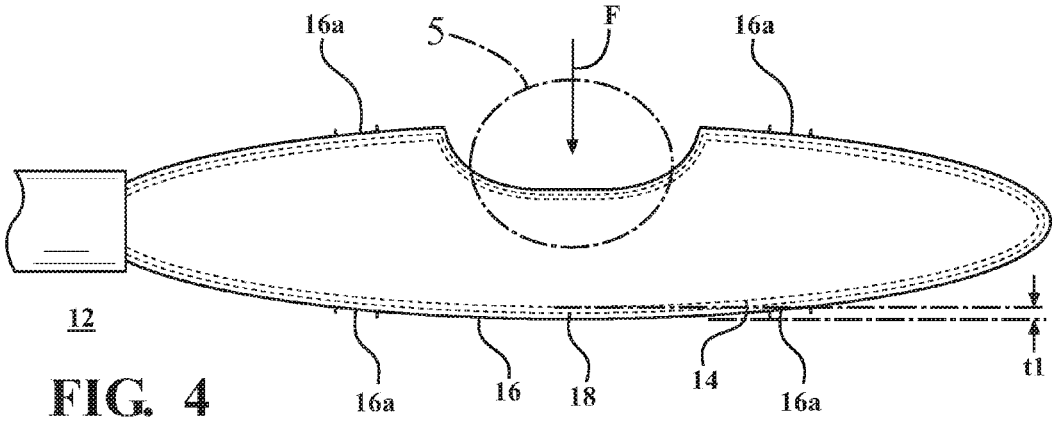
FIG. 4 is the schematic side view of FIG. 3 after application of an external load to the structural member.
Figure 5:
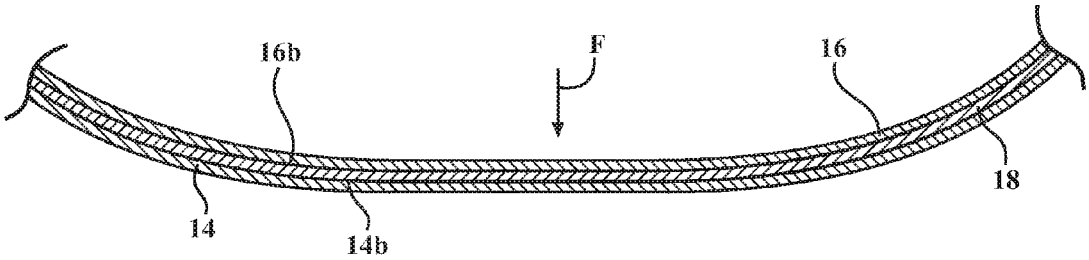
FIG. 5 is a side cross-sectional view of a loaded portion of the structural member embodiment shown in FIG. 4.

FIGS. 3-5 show views of the structural member 12 after inflation of the inflatable member 14. FIG. 3 shows a schematic side view of the structural member 12 when the inflatable member has been fully inflated and prior to application of an external load. FIGS. 4 and 5 show the inflatable member of FIG. 3 during application of an external load F. The structural member 12 may be configured so that inflation of the inflatable member 14 forces the walls of the inflatable member 14, the separator member 18, and the outer layer 16 into pressurized intimate contact with each other, and also forces the structural member 12 into its desired end-use shape. The end-use shape shown in FIGS. 3-5 is just one example of a possible end-use shape, presented here for illustrative purposes. Any of a variety of end-use shapes may be employed, to which the principles described herein are applicable.

As the inflatable member 14 is inflated, surface 14*b* of the inflatable member is brought into intimate contact with separator member surface 18*a* and the normal forces between surfaces 14*b* and 18*a* increase. Also, the separator member surface 18*b* is brought into intimate contact with outer layer surface 16*b* and the normal forces between surfaces 18*b* and 16*b* increase. Application of the external load F to the inflated structural member 12 further increases the normal forces between the various layers 14, 18, and 16. An increase in the normal forces between the contacting surfaces of adjacent layers will produce a corresponding increase in the static friction forces which must be overcome to make the surfaces slide with respect to each other. An increase in the normal forces between the contacting surfaces of adjacent layers will also produce a corresponding increase in the kinetic friction forces necessary to keep the surfaces sliding with respect to each other after they begin sliding. Thus, as the normal forces increase, sliding of the various structural member layers 14, 18, and 16 with respect to each other may be prevented or greatly inhibited.

Due to the applied inflation pressure and resulting normal forces, an effective composite wall C is formed having a thickness t1 equal to the combined thicknesses of the inflatable member 14, separator member 18 and outer layer 16 after inflation of the inflatable member 14 to a desired or predetermined pressure or level. Further increases in inter-layer normal forces due to an applied load F will result in increased resistance to relative motion between the adjacent layers (or between portions of the layers) in contact. For example, the increases in inter-layer normal forces due to inflation of the inflatable member or to application of an applied load F may increase resistance to differential stretching of the surfaces in contact. That is, with first and second layers in intimate, pressurized contact, if a first layer may tend to stretch at a different rate than the second layer responsive to an applied load, this stretching may be inhibited or prevented by increased frictional forces operating at the contact interface between the layers. The increased resistance to relative motion between layers and/or portions thereof may be manifested in an increase in stiffness of the composite wall C.

The constituent materials and wall thicknesses of the inflatable member 14, the separator member 18, and the outer layer 16 may be adjusted or specified depending on the requirements of a particular application, so as to provide a balance between the overall flexibility of the structural member 12 prior to inflation, the desired stiffness of the composite wall thickness (formed by the combined inflatable member 14, separator member 18 and outer layer 16) after inflation, and any desire to minimize the weight and/or bulk of the structural member 12 prior to inflation of the inflatable member.

Because the frictional forces preventing relative sliding of the layers increases as the pressure in the inflatable member 14 increases, the stiffness of the composite wall C of the structural member 12 just described may be controlled to some degree by correspondingly controlling the inflated pressure of the inflatable member 14. In addition, the stiffness of the composite wall C may also be affected by varying the wall thicknesses of one or more of the inflatable member 14, the separator member 18, and the outer layer 16.

It will be appreciated that the basic internal structure of the structural member described herein may be adapted to provide any of a variety of structural shapes when the inflatable member is inflated. For example, using fabrication techniques such as cutting the materials of the various layers to appropriate shapes and stitching the elements together, any of a variety of structural shapes may be provided. In addition, incorporation of the separator member(s) between the inflatable member and the outer layer may increase pliability of the structural member when the inflatable member is uninflated, and may also aid in increasing stiffness of the structural member in its inflated, final end-use condition.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g. AB, AC, BC or ABC).

In the preceding detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein. Accordingly, reference should be made to the following claims, rather than to the foregoing specification, as indicating the scope of the invention.

What is claimed is:

1. A structural member comprising:

an inflatable member having an elastic, imperforate wall;

an outer layer enclosing the inflatable member so as to define a cavity between the inflatable member and the outer layer; and at least one separator member positioned in the cavity between the inflatable member and the outer layer so as to separate the outer layer and the inflatable member, the at least one separator member being unattached to the inflatable member and the outer layer, the at least one separator member being movable with respect to the inflatable member and the outer layer prior to inflation of the inflatable member.

2. The structural member of claim 1 wherein the outer layer is stretchable.

3. The structural member of claim 2 wherein the outer layer is formed from a material having an elongation of up to about 20%.

4. The structural member of claim 2 wherein the outer layer is formed from silicone rubber.

5. The structural member of claim 1 wherein the at least one separator member is formed from a polymer material.

6. The structural member of claim 1 further comprising a plurality of separator members positioned between the inflatable member and the outer layer, each separator member being unattached to the inflatable member and the outer layer and independently movable with respect to the inflatable member and the outer layer prior to inflation of the inflatable member.

7. The structural member of claim 1 wherein the inflatable member is stretchable.

8. The structural member of claim 1 wherein the inflatable member is formed from silicone rubber.

9. The structural member of claim 1 wherein the outer layer is formed from a fiber-reinforced polymer.

10. The structural member of claim 1 wherein the outer layer has a plurality of openings formed therealong and structured to enable fluid communication between the cavity and an exterior of the structural member.

11. A structural member comprising:

an inflatable member having an elastic, imperforate wall;

an outer layer enclosing the inflatable member so as to define a cavity between the inflatable member and the outer layer, the outer layer having at least one opening formed therealong and structured to enable fluid communication between the cavity and an exterior of the structural member; and at least one separator member positioned in the cavity so as to separate the outer layer from the inflatable member, wherein the at least one separator member is structured such that a coefficient of friction between the at least one separator member and the inflatable member is less than a coefficient of friction between the inflatable member and the outer layer.

12. A structural member comprising:

an inflatable member having an elastic, imperforate wall;

an outer layer enclosing the inflatable member so as to define a cavity between the inflatable member and the outer layer, the outer layer having at least one opening formed therealong and structured to enable fluid communication between the cavity and an exterior of the structural member; and at least one separator member positioned in the cavity so as to separate the outer layer from the inflatable member, wherein the structural member is structured such that inflation of the inflatable member presses the inflatable member against the at least one separator member, so as to increase a static friction force between the at least one separator member and the inflatable member, and such that inflation of the inflatable member presses the at least one separator member against the outer layer, so as to increase a static friction force between the at least one separator member and the outer layer.

13. A structural member comprising:

an inflatable member having an elastic, imperforate wall;

an outer layer enclosing the inflatable member so as to define a cavity between the inflatable member and the outer layer, the outer layer having at least one opening formed therealong and structured to enable fluid communication between the cavity and an exterior of the structural member; and at least one separator member positioned in the cavity so as to separate the outer layer from the inflatable member, wherein the at least one separator member is structured such that a coefficient of friction between the at least one separator member and the outer layer is less than a coefficient of friction between the inflatable member and the outer layer.

14. A structural member comprising:

an inflatable member having an elastic, imperforate wall;

an outer layer enclosing the inflatable member so as to define a cavity between the inflatable member and the outer layer, the outer layer having at least one opening formed therealong and structured to enable fluid communication between the cavity and an exterior of the structural member; and a plurality of separator members positioned in the cavity so as to separate the outer layer from the inflatable member, wherein the outer layer is structured to be slidable with respect to the separator members of the plurality of separator members prior to inflation of the inflatable member, and the separator members of the plurality of separator members are structured to be slidable with respect to the inflatable member prior to inflation of the inflatable member.

* * * * *